US011585097B2

(12) United States Patent
Grifhorst et al.

(10) Patent No.: US 11,585,097 B2
(45) **Date of Patent: *Feb. 21, 2023**

(54) WHEELCHAIR RAMP SYSTEM USING STRUCTRUALLY INSULATED PANEL (SIPS)

(71) Applicant: Heated Ramps, LLC, Wyoming, MI (US)

(72) Inventors: Bruce A. Grifhorst, Grand Rapids, MI (US); Eric S. Smith, Grandville, MI (US)

(73) Assignee: Heated Ramps, LLC, Wyoming, MI (US)

( * ) Notice: Subject to any disclaimer, the term of this patent is extended or adjusted under 35 U.S.C. 154(b) by 23 days.

This patent is subject to a terminal disclaimer.

(21) Appl. No.: 17/069,786

(22) Filed: Oct. 13, 2020

(65) Prior Publication Data

US 2021/0025172 A1 Jan. 28, 2021

Related U.S. Application Data

(63) Continuation-in-part of application No. 16/738,700, filed on Jan. 9, 2020, now Pat. No. 10,801,211.

(60) Provisional application No. 62/790,282, filed on Jan. 9, 2019.

(51) Int. Cl.

| | |
|---|---|
| ***E04F 11/00*** | (2006.01) |
| ***E01H 5/10*** | (2006.01) |
| ***F24D 13/02*** | (2006.01) |

(52) U.S. Cl.

CPC ..... *E04F 11/002* (2013.01); *E01H 5/10* (2013.01); *F24D 13/024* (2013.01); *E04F 2011/007* (2013.01)

(58) Field of Classification Search

CPC .... E04F 11/002; E04F 2011/007; E01H 5/10; F24D 13/024

USPC ..... 14/69.5–72.5

See application file for complete search history.

(56) References Cited

U.S. PATENT DOCUMENTS

| | | | | |
|---|---|---|---|---|
| 4,807,317 | A * | 2/1989 | Quinn | E04F 11/181 404/43 |
| 6,427,403 | B1 * | 8/2002 | Tambakis | E04B 1/28 52/309.1 |
| 9,327,923 | B1 * | 5/2016 | Marx | B32B 37/14 |
| 10,801,211 | B2 * | 10/2020 | Grifhorst | E04F 11/002 |
| 2004/0034950 | A1 * | 2/2004 | Massaro | E04F 11/002 14/69.5 |
| 2006/0156492 | A1 * | 7/2006 | Warford | A61G 3/061 14/69.5 |
| 2007/0256379 | A1 * | 11/2007 | Edwards | B32B 5/145 52/309.9 |
| 2012/0036653 | A1 * | 2/2012 | Peters | E04F 11/002 14/69.5 |

* cited by examiner

*Primary Examiner* — Raymond W Addie
(74) *Attorney, Agent, or Firm* — Frank M. Scutch, III

(57) ABSTRACT

A wheelchair ramp system includes a ramp constructed from at least one structural insulated panel (SIP) having a foam core sandwiched between two structural facing panels such as oriented strand board (OSB). An outdoor exterior coating such as polyaspartic coating covers the SIP panel for allowing the SIP panel to be resistant to outdoor elements. At least one guardrail or handrail is secured to the side of the SIP for providing a safety barrier to persons using the ramp system.

11 Claims, 6 Drawing Sheets

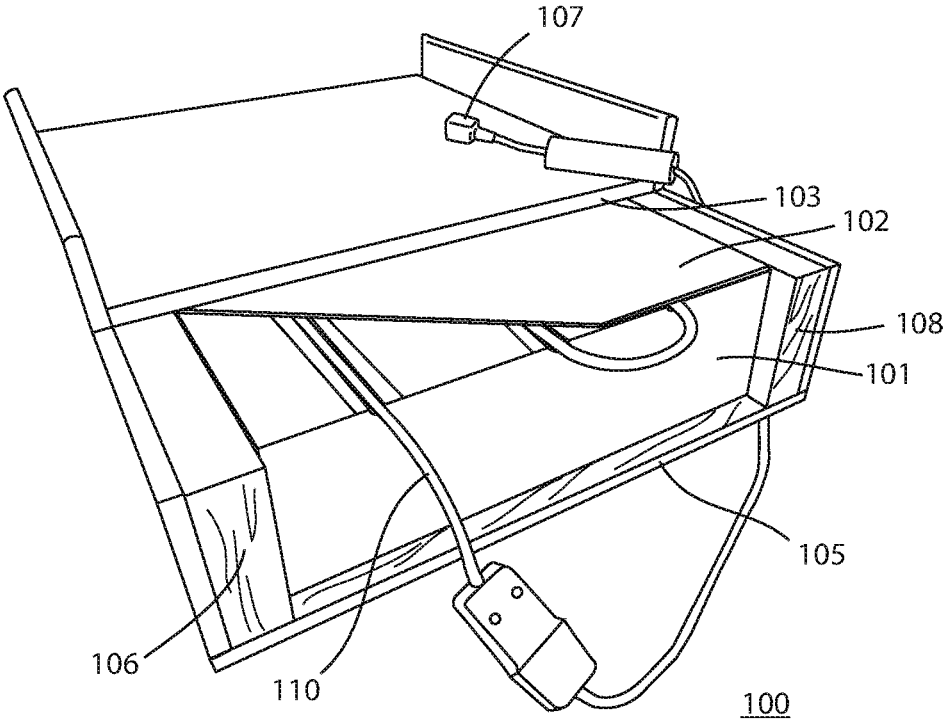
FIG. 1A
FIG. 1B
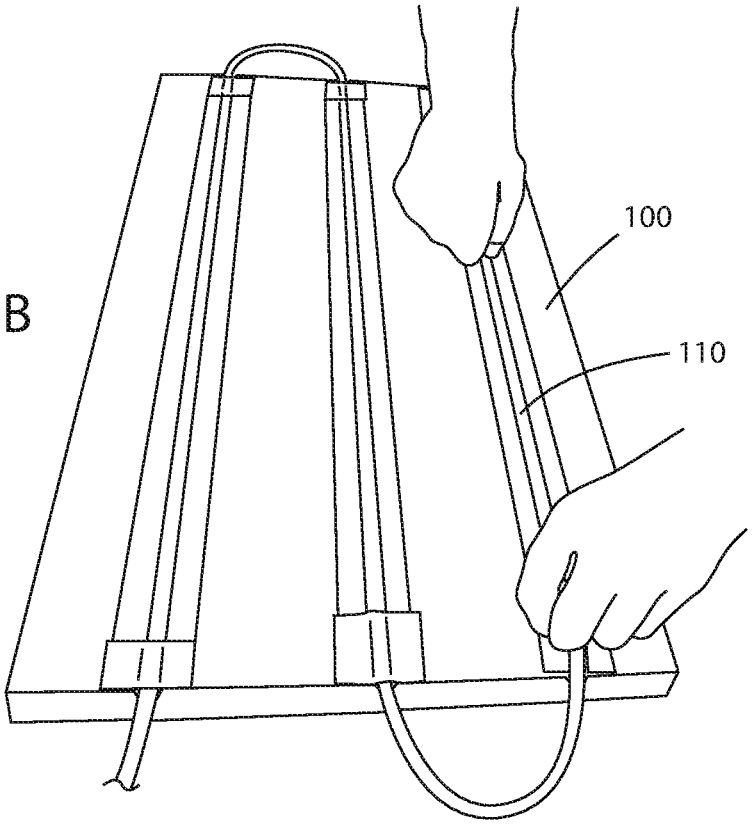

WHEELCHAIR RAMP SYSTEM USING STRUCTRUALLY INSULATED PANEL (SIPS)

FIELD OF THE INVENTION

The present invention relates generally to wheelchair ramps and more particularly to a wheelchair ramp with heated floor for use in cold climates.

BACKGROUND

Wheelchair ramps are well known in the art and often are manufactured of tubular steel or aluminum. Tubular steel is often expensive and difficult to manufacture in view of the varying types so structures the ramp is often used. Moreover, an additional problem associated with these ramps occurs in cold climates when snow and ice buildup on the ramp's surfaces. Difficult cold climate conditions can prevent safe ingress and egress from the building. Thus, new ramp solutions are required to overcome these drawbacks.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 1A is a cross-sectional view illustrating the components in a heated wheelchair ramp system in accordance with an embodiment of the invention.

FIG. 1B is perspective view illustrating the cable routed in the channel to provide heat to the panel.

Figure 2:
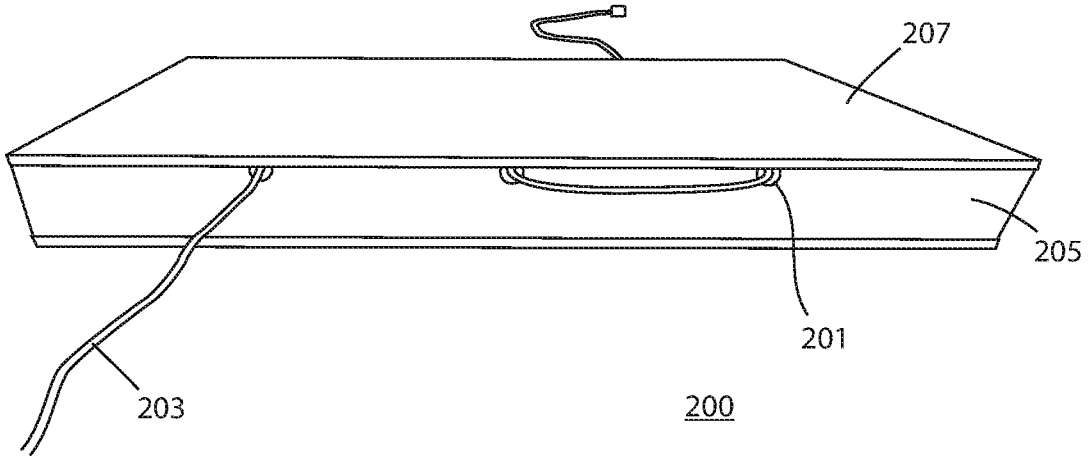
FIG. 2 is a side view illustrating the heated wheelchair ramp shown in FIG. 1.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a heated wheelchair ramp. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1A is a cross-sectional view illustrating the components in a heated wheelchair ramp system in accordance with an embodiment of the invention. FIG. 1B is perspective view illustrating the cable routed in the channel to provide heat to the panel. FIG. 2 is a side view illustrating the heated wheelchair ramp shown in FIG. 1. The wheelchair ramp floor 100 is comprised of a structural insulated panel (SIP). The SIP is a high-performance building system used for both residential and light commercial construction. As seen in FIG. 1A, FIG. 1B and FIG. 2, the SIP consists of an insulating foam core 101 sandwiched between two structural facings 103, 105, side member 106 and side member 108. The side members 106, 108 might be made of 2-inch×4-inch lumber or the like. A top structural facing 103 and bottom structural facing 105 are sheets of material that are typically manufactured of oriented strand board (OSB). Those skilled in the art will recognize that marine plywood, wolmanized plywood, regular, OSB and/or structural panel sheet might also be used as well. As further described herein, a heating cable 110 is configured within the foam core 101 to provide and radiate heat into the foam core 101. A metallic heat conductor, such as aluminum sheet 102 is used under the top structural facing 103 to distribute heat across the top structure facing 103 enabling ice and snow to be easily melted. An AC electrical connector 107 provides power to the heating cable 110 typically rated at at least 3 watts/ft. The heating cable 110 is typically installed in a serpentine shape for providing conductive heat transfer to as much surface area of the structural facing as possible.

As used herein, SIPs are often used for exterior walls, roof panels, and sub-floors and are typically not manufactured as a "stand-alone" product for use outdoors. Those skilled in the art will recognize that moisture, mold, and rot can occur with a SIP if the product does not have a water and/or vapor barrier. Typically, the water barrier used for a SIP might be either siding or roofing. For this reason, SIPs have not been used for a wheelchair ramp application, since any SIP without a barrier cannot withstand the outside elements or having the durability needed the withstand the wear that would be present from a from a motorized wheelchair.

In order to provide a barrier to the elements, the present invention uses a water or vapor coating in the ramp system 100. By way of example and not limitation, a polyaspartic coating may be used on the top structural facing 103 and bottom structural facing 105. An outdoor or exterior coating such as polyaspartic is a protective steel coating, offering corrosion prevention for bridges and other harsh environment applications. Polyaspartic resins offer many benefits over traditional resins such as higher abrasion resistance, chemical resistance, faster installation, and higher overall performance. The 100% solids version has no odor, solvent, or VOCs. As polyaspartic technology has evolved, polyaspartic floor coating systems have been found beneficial as a structural element of the present invention. Thus, although SIPs are not typically used in an outdoor application, the invention transforms a typically interior product to an exterior product though the use of polyaspartic resin.

In order to prevent snow and ice from accumulating on the ramp, the ramp also includes a heating cable configured into the SIPS panel. FIG. 2 shows the SIP 200 with a channel 201 included therein where a heating cable 203 is routed through the channel 201. The heating cable 203 is an electric cable that works to heat a metallic sheet 205 enabling the surface of the top structural facing 207 to remain clear of snow and ice. Those skilled in the art will further recognize, that the channel is cut into the foam of the SIP over the length of the panel just below the top sheet of OSB and metallic sheet 205. Although the heating cable 203 might typically be used for melting snow and ice on roofs, it also works well for a heated wheelchair ramp application. Although a hydronics heating system is typically used for an "in floor applications" that uses heated water in a tube, the channel and heated cable works very well to melt ice and snow. Thus, the construction of the present invention using a SIPs panel permits the use of a heated cable, which is more cost effective than a radiant hydronic system.

Figure 3:
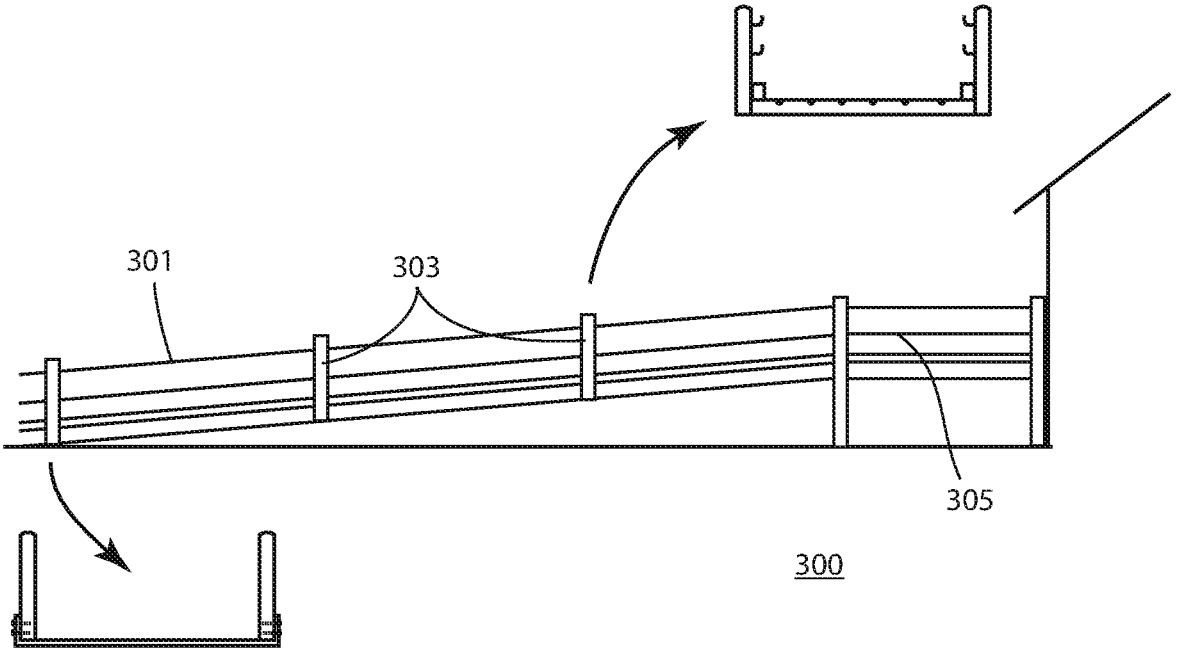
FIG. 3 illustrates a side view of the heated wheelchair ramp system in accordance with an embodiment of the invention.

FIG. 3 is an illustration of a side view of the heated wheelchair ramp system in accordance with a wheelchair ramp system 300. In still another aspect of the invention, the heated wheelchair ramp can also use an aluminum continuous handrail 301. The use of a handrail is needed in order for the ramp system to be ADA compliant. In one application, the handrail product used might be that made by Digger Specialties Inc. This handrail 301 is multipurpose rail and can be used as either a handrail or guardrail. As seen in FIG. 3, the handrail 301 is attached to 4-inch×4-inch posts 303 every 6-8 feet. The handrail 301 is installed horizontally at the height of approximately 36 inches and a second will be installed at 18", therefore also making a "guardrail" 305.

Figure 4:
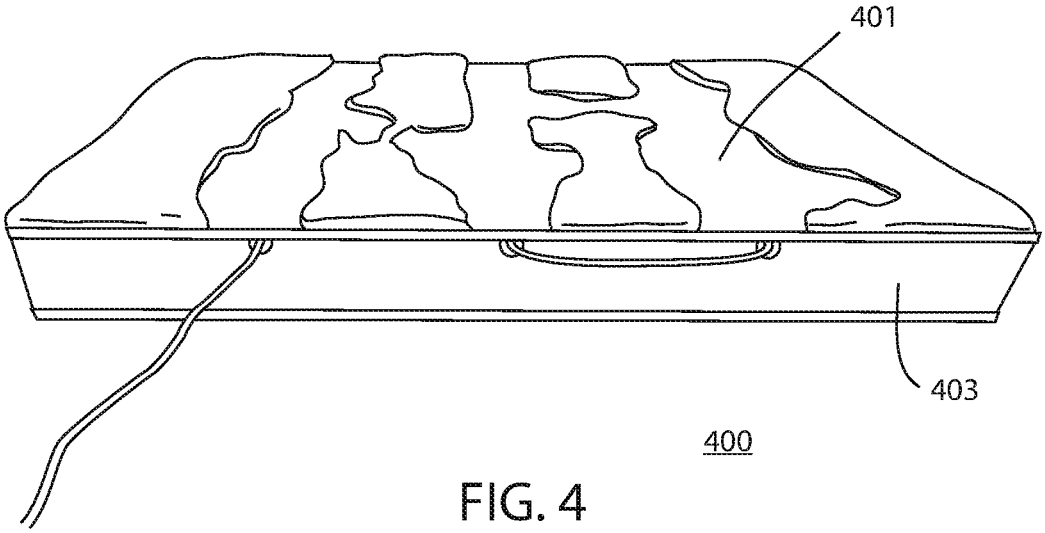
FIG. 4 a perspective view illustrating the melting of ice on the ramp when heat is applied to the system as described herein.

FIG. 4 illustrates the heated wheelchair ramp system 400 as described herein where ice 401 is melting on the ramp 400 when heat is applied to the system. As described herein, the metallic sheet 403 under the top structure facing works to more evenly distribute the heat. Although a wheelchair ramp is described herein, those skilled in the art will recognize that other applications are also possibilities such as pedestrian bridges, boat docks, decks, sidewalks or the like using alternative configurations of SIPs, polyaspartic coating and heating elements are also possible.

Figure 5:
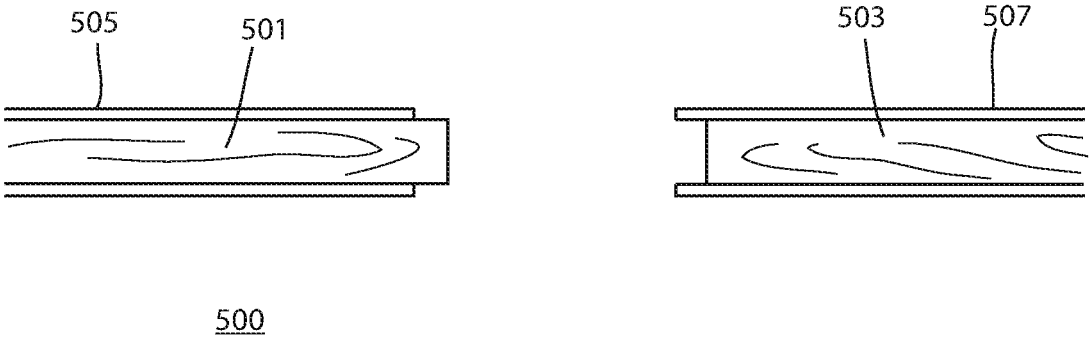
FIG. 5 is a side view illustrating the joinder of two SIP panels.

FIG. 5 is a side view illustrating joiner inter-locking SIP panels. In this example, a first 2-inch×4-inch member has a protruded end while a second or receiving 2-inch×4-inch member has an intruded end allowing the SIP panel surfaces 505, 507 to be easily join together during construction making a contiguous, uninterrupted surface for walking or rolling a wheel chair or the like. Thus, both the 2×4 inch member and the foam may include a protruded or intruded end to facilitate a seamless type joint.

Figure 6A:
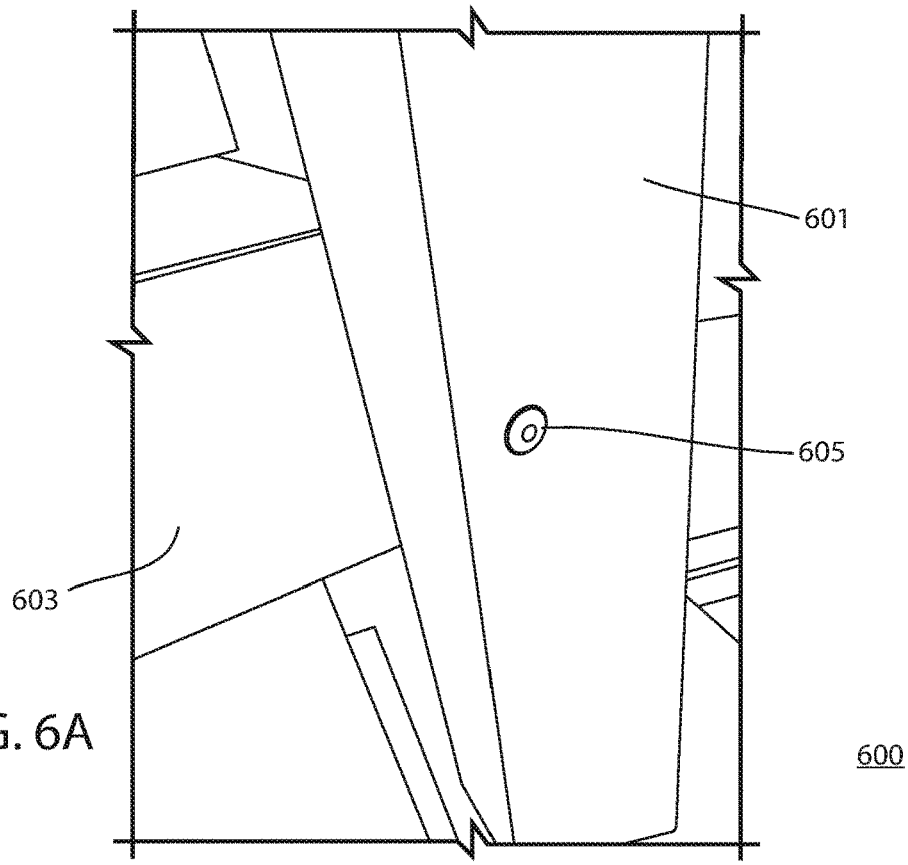
FIG. 6A is a perspective view showing the guard rail attached to the ramp system.
Figure 6B:
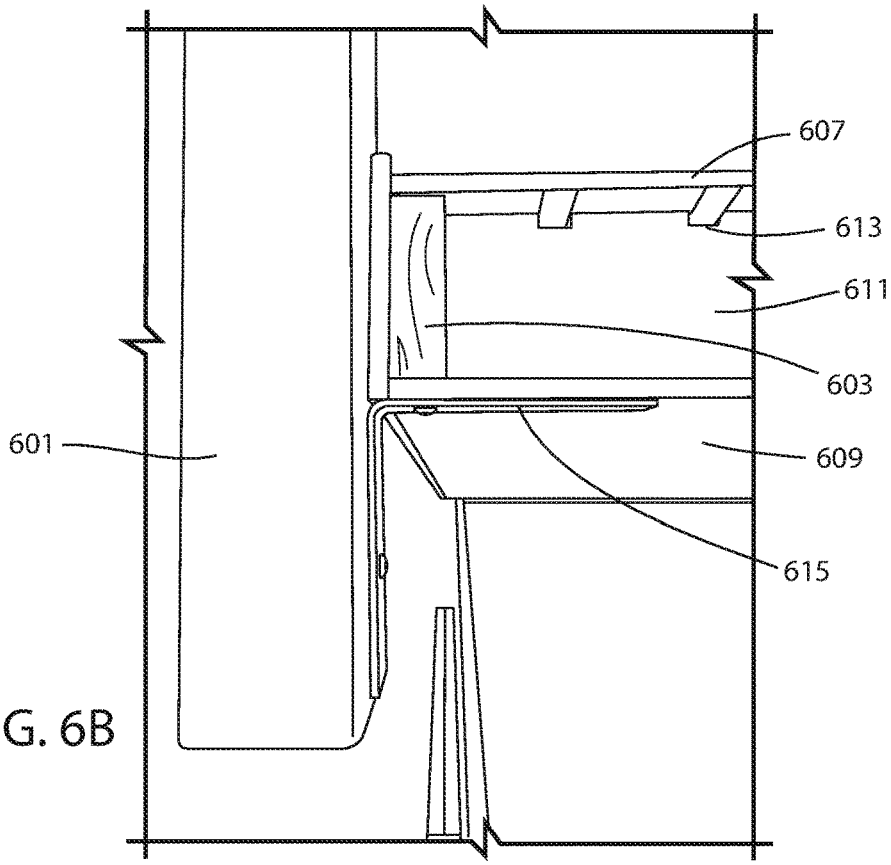
FIG. 6B is a side view of the guide rail attached to the ramp system.

FIG. 6A is a perspective view showing the guard rail attached to the ramp system. FIG. 6B is a side view of the guide rail attached to the ramp system. With regard to both FIG. 6A and FIG. 6B, the guide rail post assembly 600 includes one or more posts 601 that are fastened to a side member 603 of the rail system. As described herein, the side member 603 may be a 2 in×4 in or the like. The top structural facing 607 and bottom structural facing 609 are shown as the outside surfaces to the foam 611 and metallic sheet 613. Further, the guide rail assembly 600 uses a first fastener 605 such as a screw or the like that is driven orthogonally though the post 601 into the side member 603. A second fastener such as L-bracket 615 works to firmly secure the post 601, side member 603 and bottom structural facing 609 together. This allows the post 601 and guard rail system 600 to be firmly held in a fixed position.

Figure 7:
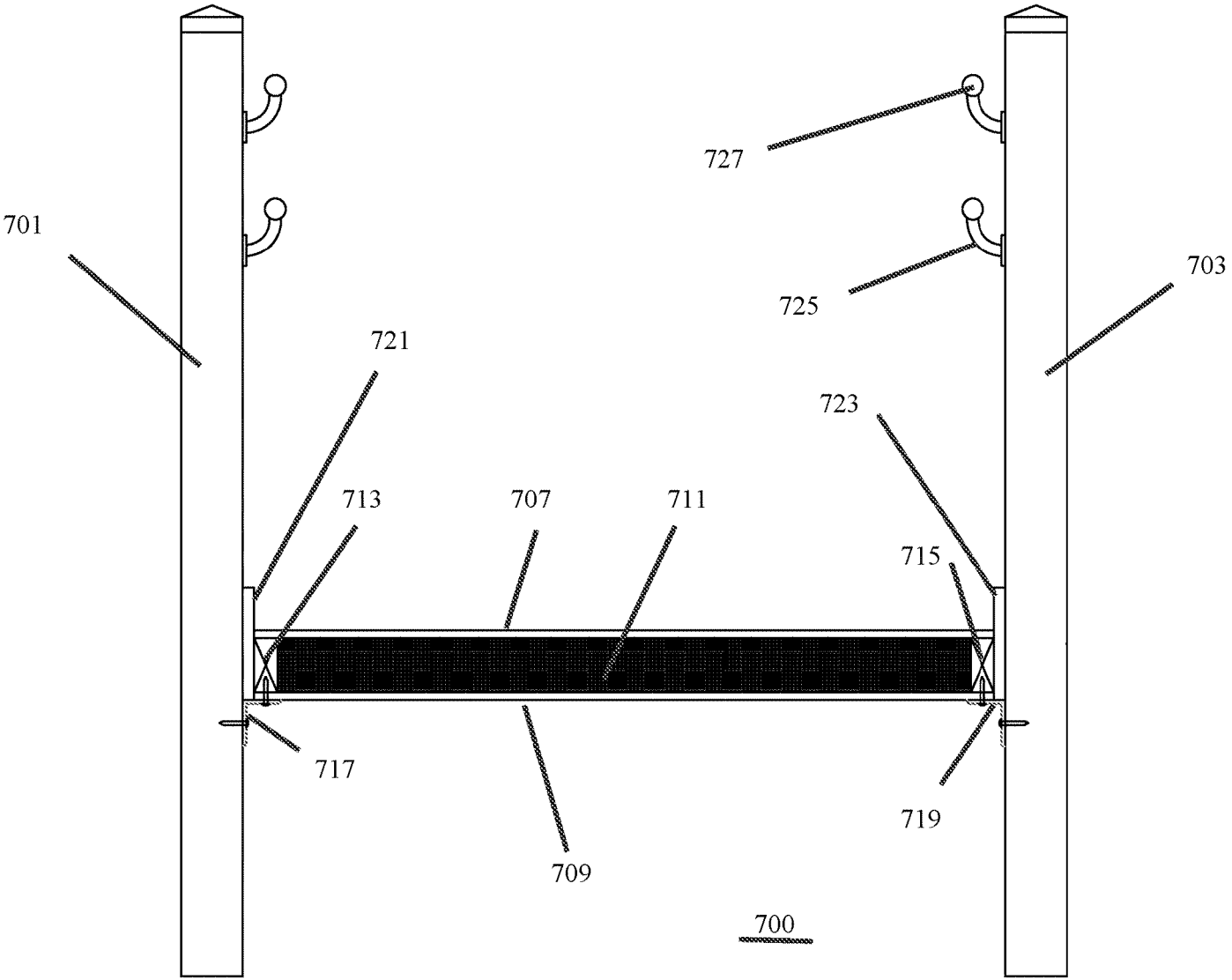
FIG. 7 illustrates a side view of the wheelchair ramp system according to an alternative embodiment of the invention.
Figure 8D:
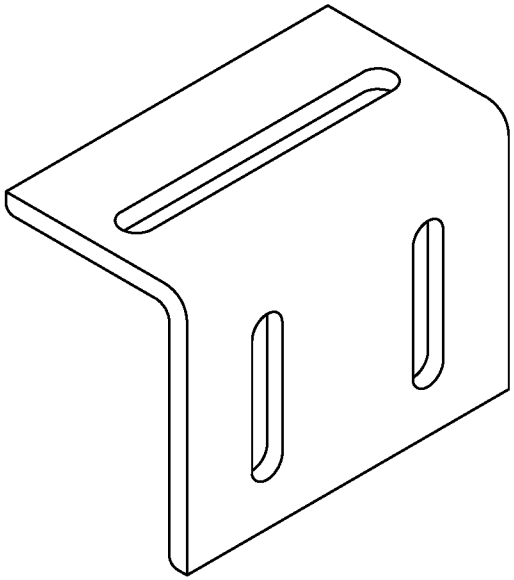
FIG. 8A, FIG. 8B, FIG. 8C and FIG. 8D illustrate top, side, front and perspective views respectively of an angle bracket used to brace the SIP panel used in the embodiment of FIG. 7.
Figure 8C:
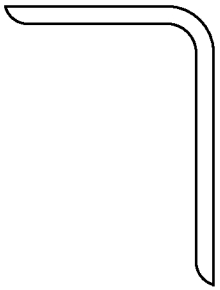
Figure 8A:
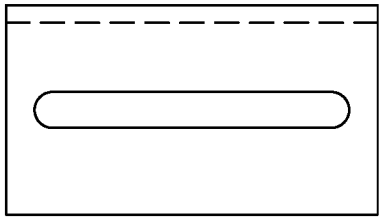
Figure 8B:
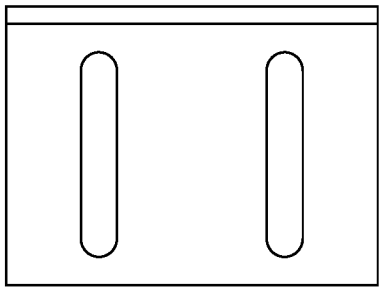

FIG. 7 illustrates a side view of the wheelchair ramp system according to an alternative embodiment of the invention. A wheelchair ramp system 700 includes a first plurality of side rails 701 and a second plurality of side rails 703. The first plurality of side rails 701 and second plurality of side rails 703 can typically be made of 4-inch×4-inch wolmanized pose with a vinyl sleeve.

Spanning between the side rails is at least one SIP panel 705 that is used to form the flooring surface suspending above the ground. As described herein, the SIP panel includes a top substrate 707 and bottom substrate 709 where an EPS foam center core 711 is configured between the top and bottom substrates to provide support yet forming a strong supporting surface. The top substrate 707 and bottom substrate 709 are typically manufacture of wolmanized plywood or fiberglass reinforced panels (FRP) board. A first support 713 and second support 715 may be 2-inch×4-inch boards that wedge the center core 711 laterally between a respective one of the first plurality of side rails 701 and second plurality of side rails 703. Spacers 721, 723 are configured adjacent to the first support 713 and second support 715 respectively to adjust spacing of the SIP panel 705 between a first side rail 701 and second side rail 703. Those skilled in the art will further recognize that the first support 713 and second support 715 may also be manufactured of wolmanized wood or the like for enduring moist weather conditions without wood rot or deterioration. A first plurality of support brackets 717 and second plurality of support brackets 719 work to further support the SIP panel 705 by attaching the underside of each SIP panel 705 to the side of respective support.

Finally, a plurality of rail brackets 725 are used hold a continuous hand rail 727 to the side of the first plurality of side rails 701 and second plurality of side rails 703. Thus, in the wheelchair ramp system as described in FIG. 7, the top and the bottom substrate is an exterior structural panel are typically constructed of materials intended to be used outdoors. In the embodiment, no heating element is used. A structurally insulated panel (SIPS) is used as a support base where a foam core is sandwiched pressed and/or glued between a top and bottom substrate. A rail and post arrangement work to provide support and safety to persons using the ramp system.

FIG. 8A, FIG. 8B, FIG. 8C and FIG. 8D illustrate top, side, front and perspective views respectively of an support bracket used to brace the SIP panel used in the embodiment of FIG. 7. Each support bracket is manufactured of steel such as angle iron having one or more elongated slots of adjusting its position while attached while under the SIP and to the side of a respective side rail.

Thus, the wheelchair ramp system as described herein, is unique in its use of SIPS panels for the infrastructure for a wheelchair ramp. The SIPS panels are used with a unique coating, with heated floor and rail. The wheelchair ramp system as described herein, has the ability of being completely free standing, as it has a load capability of approximately 60 pounds per square foot (lbs/sq-ft). Since the SIPS panels are manufactured in 4 ft×24 ft long sections, this enables the ramp construction to span 24 feet without any added support. The present invention can withstand the harshest weather conditions, because of the characteristics of the polyaspartic coating. Moreover, SIPS are used with a railing system, enabling the wheelchair ramp to be custom designed to any application.

In the foregoing specification, specific embodiments of the present invention have been described. However, one of ordinary skill in the art appreciates that various modifications and changes can be made without departing from the scope of the present invention as set forth in the claims below.

Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A wheelchair ramp system comprising:

a ramp constructed from at least one structural insulated panel (SIP) having a foam core sandwiched between two oriented structural facing panels;

an exterior coating covering the SIP panel for allowing the SIP panel to be resistant to outdoor elements;

at least one guardrail secured to the side of the SIP for providing a safety barrier to persons using the ramp system; and wherein the two structural facing panels include a first panel that forms a top surface of the ramp system and second panel that forms the bottom surface of the ramp system.

2. A wheelchair ramp system as in claim 1, wherein the structural facing panels are oriented strand board (OSB).

3. A wheelchair ramp system as in claim 1, wherein the exterior coating is a polyaspartic coating.

4. A wheelchair ramp system as in claim 1, wherein the foam core includes at least one channel cut therein for placement of a heating element.

5. A wheelchair ramp system comprising:

a ramp constructed from at least one structural insulated panel (SIP) having a foam core sandwiched between two structural facing panels;

an exterior coating covering the SIP panel for allowing the SIP panel to be resistant to outdoor elements at least one guardrail secured to the side of the SIP for providing a safety barrier to persons using the ramp system; and wherein the two structural facing panels include a first panel that forms a top surface of the ramp system and second panel that forms the bottom surface of the ramp system and the foam core includes at least one channel cut therein.

6. A wheelchair ramp system as in claim 5, wherein the structural facing panels are oriented strand board (OSB).

7. A wheelchair ramp system as in claim 5, wherein the exterior coating is a polyaspartic coating.

8. A wheelchair ramp system as in claim 5, further comprising:

a heating element is installed within the SIP having a serpentine shape.

9. A wheelchair ramp system comprising:

a first oriented strand board (OSB) panel forming a top ramp surface;

a second OSB panel forming a bottom ramp surface;

a foam core sandwiched between the first OSB panel and second OSB panel;

a polyaspartic coating covering the first OSB panel and second OSB panel for allowing the panels to be resistant to outdoor elements;

at least one guardrail secured to the side of the SIP for providing a safety barrier to persons using the ramp system.

10. A wheelchair ramp system as in claim 9, further comprising a heating element configured within a channel cut into the foam core.

11. A wheelchair ramp system as in claim 10, wherein the heating element is installed in a serpentine shape.

* * * * *